US007934363B2

(12) United States Patent
Vollmecke et al.

(10) Patent No.: US 7,934,363 B2
(45) Date of Patent: May 3, 2011

(54) STIRRUP INSERT FOR A STIRRUP

(75) Inventors: Valentin Vollmecke, Iserlohn (DE); Heinz Baumann, Iserlohn (DE)

(73) Assignee: Herm, Sprenger GmbH & Co. KG (DE)

( * ) Notice: Subject to any disclaimer, the term of this patent is extended or adjusted under 35 U.S.C. 154(b) by 276 days.

(21) Appl. No.: 12/293,410

(22) PCT Filed: Mar. 2, 2007

(86) PCT No.: PCT/EP2007/052016

§ 371 (c)(1), (2), (4) Date: Sep. 17, 2008

(87) PCT Pub. No.: WO2007/107440

PCT Pub. Date: Sep. 27, 2007

(65) Prior Publication Data

US 2009/0077934 A1 Mar. 26, 2009

(30) Foreign Application Priority Data

Mar. 17, 2006 (DE) ..... 10 2006 012 702

(51) Int. Cl.
*B68C 3/00* (2006.01)

(52) U.S. Cl. ..... 54/48; 54/47

(58) Field of Classification Search ..... 54/47, 48, 54/49

See application file for complete search history.

(56) References Cited

U.S. PATENT DOCUMENTS 5,172,538 A * 12/1992 Luger ..... 54/47
2003/0140605 A1 7/2003 Hsi-Chang

FOREIGN PATENT DOCUMENTS

FR 2 670 197 A1 * 6/1992
WO 2006021621 3/2006

OTHER PUBLICATIONS

International Search Report PCT/EP2007/052016; Dated Jun. 27, 2007.

* cited by examiner

*Primary Examiner* — Rob Swiatek
(74) *Attorney, Agent, or Firm* — Cantor Colburn LLP

(57) ABSTRACT

A stirrup insert for a stirrup including a bearing surface which is provided with a surface for placing a boot, and a holding area which can be detachably connected to the stirrup, where the bearing surface includes an internal part and an external part, where the internal part is surrounded by the external part at least in the z-direction, preferably, the internal part is softer than the external part.

17 Claims, 3 Drawing Sheets

STIRRUP INSERT FOR A STIRRUP

TECHNICAL FIELD OF THE INVENTION

The invention relates to a stirrup insert for a stirrup, said stirrup insert having a bearing surface which has a surface for placing a boot and a holding area which can be detachably connected to the stirrup.

BRIEF DESCRIPTION OF RELATED ART

Such type stirrup inserts are known and belong to the state of the art; the reader is referred to U.S. Pat. No. 6,766,632 B2 by way of example.

Stirrup inserts are intended to have a high enough friction coefficient with respect to the boot sole of a rider in order for it not to slide easily with respect to the boot and if possible not to slide out of place. Further, they are intended to exhibit certain elasticity and thus have a dampening function, for example in leaps.

The disadvantage of the previously known stirrup inserts is that they are made from the same material. As a result, only certain needs of a rider are met. One and the same material cannot be soft and hard at the same time, have a high coefficient of friction or not, and so on. This is where the invention comes in. It is directed at developing the stirrup insert so as to provide for greater freedom of the respective properties.

BRIEF SUMMARY OF THE INVENTION

Accordingly, the invention provides the stirrup insert of the type mentioned herein above in such a manner that it is capable of simultaneously meeting several requirements, such as a hard and at the same time soft implementation.

In view of the stirrup insert of the type mentioned herein above, this is achieved in that the bearing surface has an internal part and an external part, that the external part forms a surrounding grip around the internal part and that the internal part is preferably configured to be softer than the external part.

The internal part and the external part of this stirrup insert can be formed differently, with the internal part being for example configured to be softer than the external part. The internal part can however also slightly project upward with respect to the external part. It is possible to connect together the internal part and the external part so that there is provided a one-piece stirrup insert as it is known in prior art. It can however also be formed from two pieces with the internal part not being connected to the external part and comprising holding means of its own in order to retain the internal part either on the external part or directly on the stirrup.

In a preferred development, the hardness of the internal part is 20 to 50 Shore and the hardness of the external part is 50 to 90 Shore. The internal part is responsible for contact and good friction, the external part, for precise contact with the stirrup. Preferably, the external part is at least 10 Shore harder, preferably at least 20 Shore harder than the internal part.

The internal part and the external part can be formed differently in various ways. The internal part can for example be built from two layers, an upper, closed and thinner layer being resilient and a lower layer being extremely soft, in any case softer than the upper layer, and made from foam rubber, an air chamber, a material with cell structure or the like. The hardness of the external part preferably corresponds to the hardness of the stirrup inserts as they are offered by the applicant for the stirrup according to EP 1 003 688 B1. By contrast, the internal part is softer.

Usually, the surface of the stirrup insert is studded or has another form of profile; in any case does it have projections. The difference between the internal part and the external part can now be achieved by a finer structure of the internal part as compared to the external part. On the internal part, the studs can also project farther so as to become generally softer.

It is also possible to make the internal part from a softer material than the external part; softer set elastomers can for example come into consideration for the internal part and slightly harder set elastomers for the external part.

BRIEF DESCRIPTION OF THE DRAWINGS

Other features and advantages will become more apparent upon reviewing the appended claims and the following non restrictive description of four embodiments of the invention, given by way of example only with reference to the drawing. In said drawing:

DETAILED DESCRIPTION OF THE INVENTION

Figure 2:
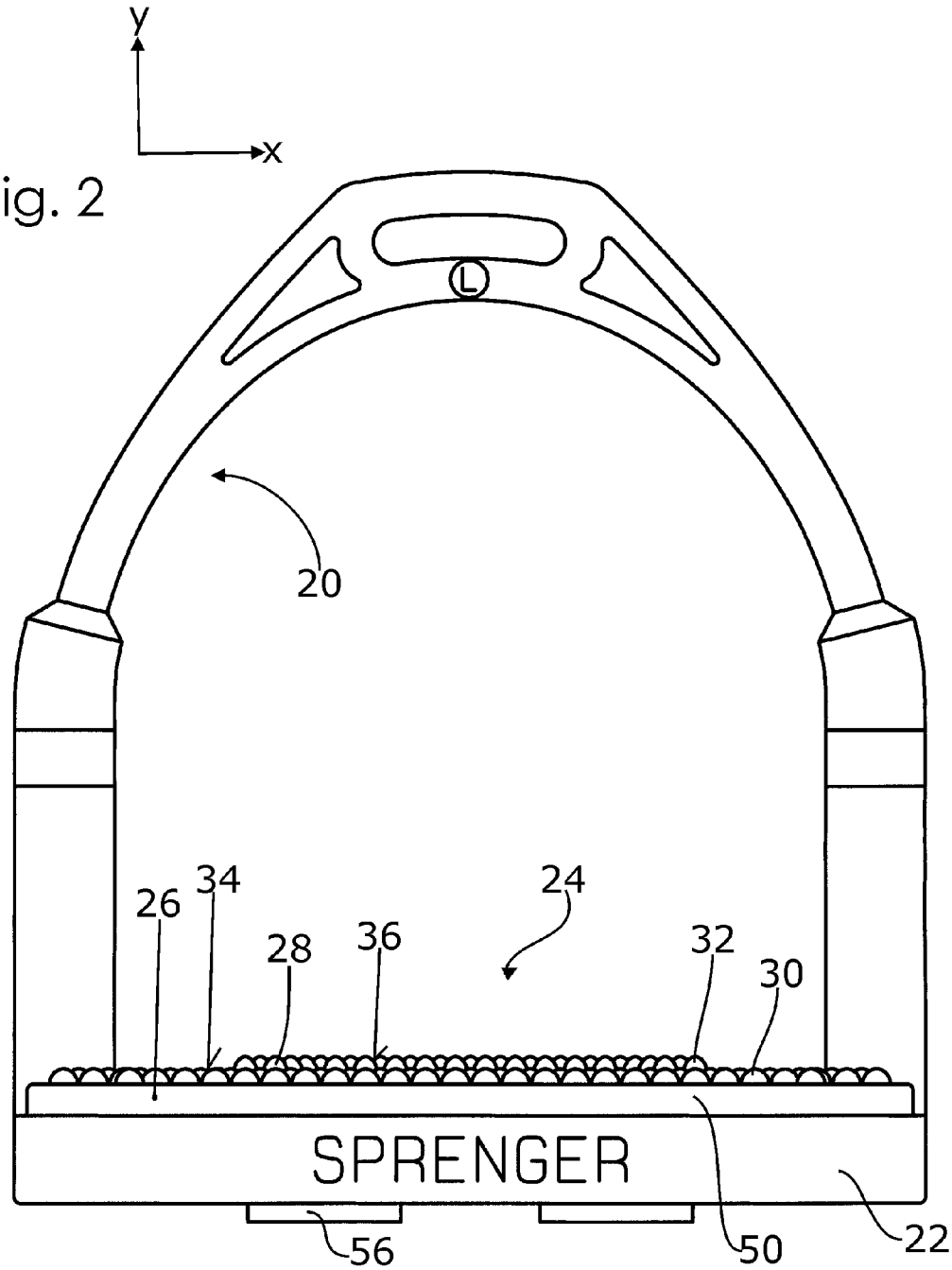
FIG. 2: is a front view of the stirrup with stirrup insert according to FIG. 1, FIG. 3: is a top view of a frame-shaped external part of the stirrup insert as it is inserted in the FIGS. 1 and 2, FIG. 4: is a sectional view taken along section line IV-IV in FIG. 3, FIG. 5: is an end view of the illustration shown in FIG. 3, FIG. 6: is a top view of an internal part of the stirrup insert as shown in the FIGS. 1 and 2, FIG. 7: is a sectional view taken along section line VII-VII in FIG. 6, FIG. 8: is a sectional view like FIG. 7, but in another implementation.
Figure 1:
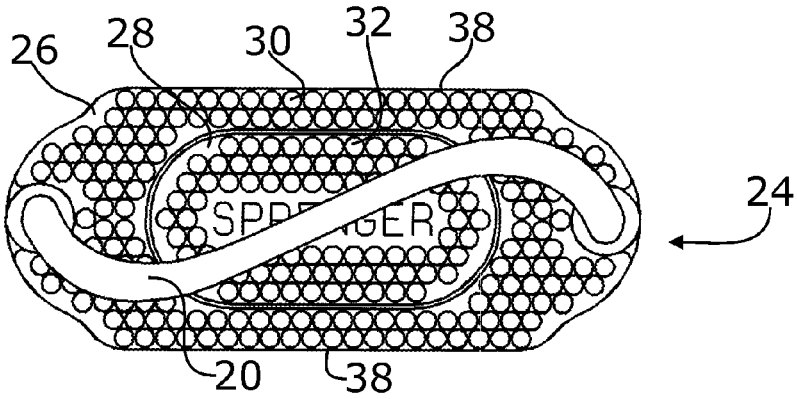
FIG. 1: is a top view of a stirrup with inserted stirrup insert of the invention.
Figure 4:
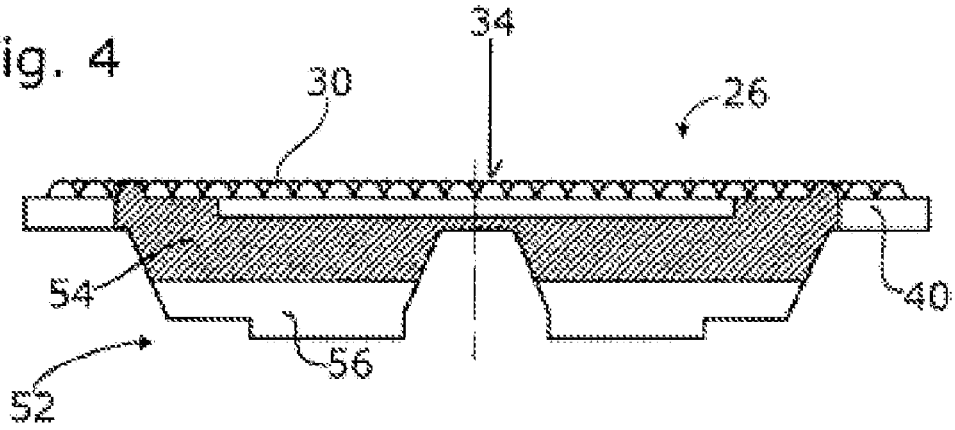
Figure 3:
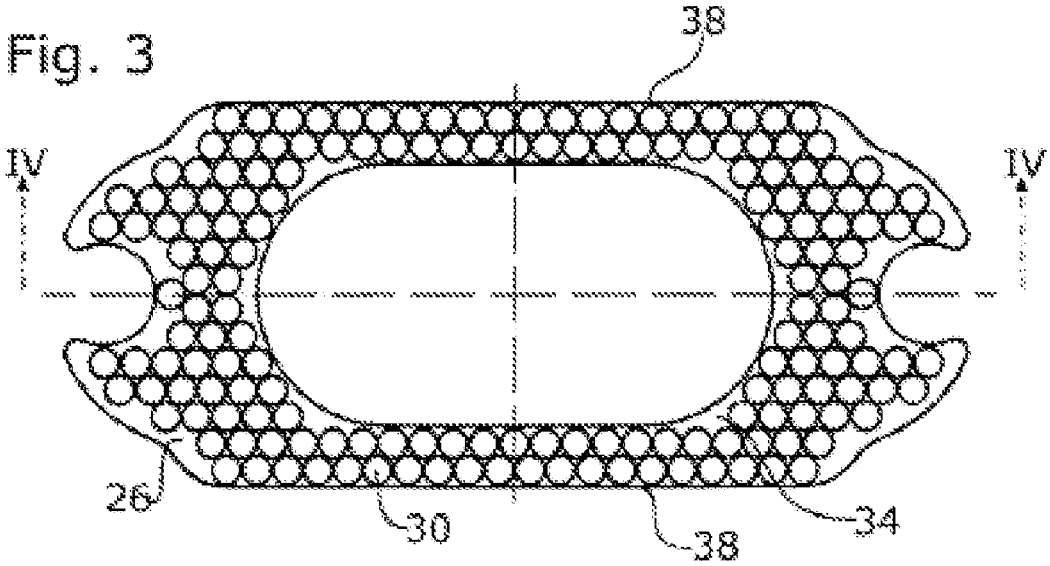
Figure 5:
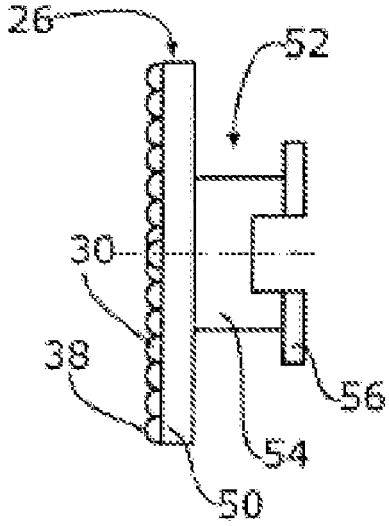
Figure 7:
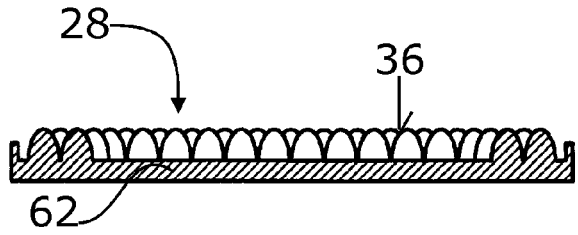
Figure 6:
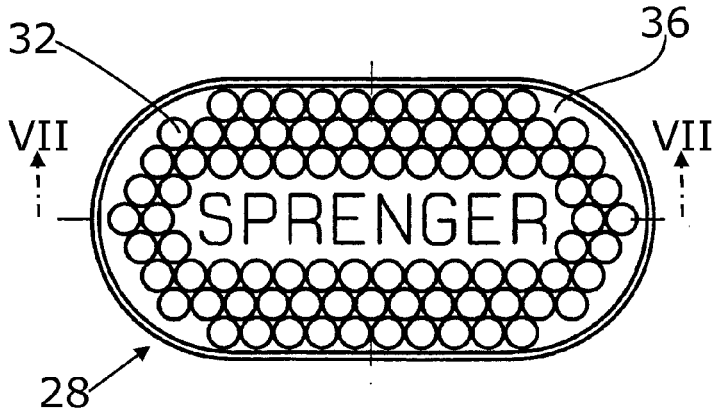

A complete stirrup can be seen from the FIGS. 1 and 2; the FIGS. 3 through 7 illustrate different component parts of the stirrup. It has a U-shaped piece 20, a step plate 22 connected to said piece 20 and a stirrup insert 24 of the invention detachably connected to said step plate 22. The concrete implementations of piece 20 and step plate 22 are discussed in the patent application under the title "Stirrup with Step Plate" of the same application date. The disclosure of said patent is fully incorporated herein by reference. The S-shape of the piece 20 is visible, a left stirrup being shown. On the right stirrup, it extends in a Z shape as obtained in the mirror image of FIG. 1.

The stirrup system 24 has a frame-shaped external part 26 and an internal part 28 enclosed therein. The internal part 28 has an oval shape. In the implementation as shown in the FIGS. 1 through 7, which constitutes the first exemplary embodiment, external part 26 and internal part 28 are permanently joined together. They are made separately but form a unit in the finished, assembled condition.

As can be seen from the Figs., the external part 26 has, inside the arms of the piece 20, a dimension that corresponds approximately to 1.2 times the corresponding dimension of the internal part 28. The corresponding dimension ratio can range between 1.1 and 3. Transverse thereto, meaning in the z direction, the width dimension of the external part 26 is about 1.5 times the corresponding width dimension of the internal part 28. Here, the ratio can range between 1.2 and 3.

The internal part 28 is configured to be softer than the external part, this being achieved by appropriate measures. The difference between the Shore hardness of the softer internal part and the harder external part is at least ten degrees of Shore hardness, preferably more, for example 20 or 30. In the first exemplary embodiment, the internal part is softer because the material from which it is made is softer. Different rubber materials or elastomers are used for the two parts 26, 28.

Both the surface 34 of the external part 26 and the surface 36 of the internal part 28 are formed by dome-shaped studs 30, 32. The studs 30 of the external part 26 are not as high as the studs 32 of the internal part 28; the difference is at least 1 mm. In the concrete exemplary embodiment, the height of the studs 30 of the external part 26 is only 55% of the height of the studs 32 of the internal part 28. The difference in height can range between 1 and 7 mm.

The surfaces of the external part 26 and the surface of the internal part 28 are level, they extend parallel to the x-z plane. Together, they form the surface of the stirrup insert 24. In the exemplary embodiment, the surface 34 of the external part 26 is located approximately 2 mm underneath the surface 36 of the internal part 28.

It is preferred that the external part 26 be configured in the form of a frame with a window that completely surrounds the internal part 28. The stirrup insert 24 has upper edges 38 which extend parallel to the x direction. It is particularly preferred that the external part 26 forms these bounding edges 38. The internal part 28 is intended to be spaced a distance of at least 5 mm apart from these edges 38 on either side in the z direction. As a result, the harder outer part 26 forms the area about the edges 38, so that the rider has a firmer and tighter feeling. As a result, the internal part 28 is substantially responsible for adherence whereas the external part 26 also serves for guiding. It is possible that the internal part 28 extends as far as the arms of the piece 20, and possibly even beyond, so that the internal part 28 can extend over the entire length of the stirrup insert 24 in the x direction.

Preferably, the stirrup insert 24 is implemented such that, if the sole of a boot is loaded normally, the internal part 28 is pressed farther inward than the external part 26. In the used condition, both surfaces 34, 36 then substantially lie in one plane that is parallel to the x-z plane.

The stirrup insert has a bearing surface 50. It is located above the step plate 22. In the first exemplary embodiment, it is formed by the internal part 28 and by a portion of the external part 26. The stirrup insert 24 further has a holding area 52. It is connected integral with the external part 26 and formed in accordance with prior art. It has an intermediate piece 54 that locates in at least one recess of the step plate 22 and holding arms 56 that project from underneath the step plate 22 and engage laterally underneath said step plate. Corresponding constructions are known in prior art and need not be discussed in closer detail herein.

In the first exemplary embodiment, the holding area 52 is formed by the external part 26 only. It is possible to also assign holding functions to the internal part 28, meaning to form part of the holding area there. It is preferred that at least one portion of the holding area 52 be provided on the external part 26, preferably integral therewith.

Figure 8:
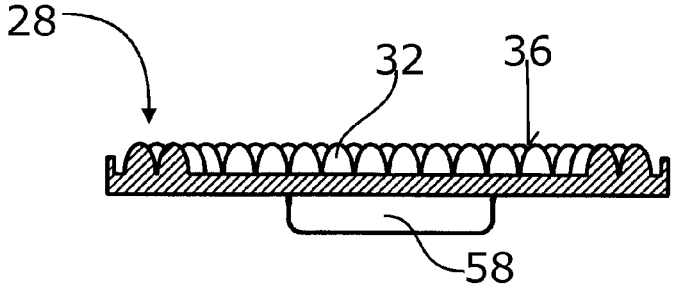

FIG. 8 shows an implementation wherein a shoulder 58 is added to a lower surface of the internal part 28 shown. This shoulder has functions like the holding area 52. In the concrete exemplary embodiment however, it does not directly abut the step plate 22 but corresponding walls of the external part 26, concretely an inner wall of the external part 26. The internal part 28 according to the implementation shown in FIG. 8 is not solidly connected to the associated external part 26. The external part 26 shown in the FIGS. 3 through 5 can be used. It is possible to make different implementations of the internal part 28 shown in FIG. 8, for example with differing stud formation, different surfaces, different material hardness, and so on, this also applying for the following exemplary embodiments. The discrete internal parts 28 can then be exchanged. The external part 26 must not be removed from the stirrup; it can remain on the step plate 22.

Figure 9:
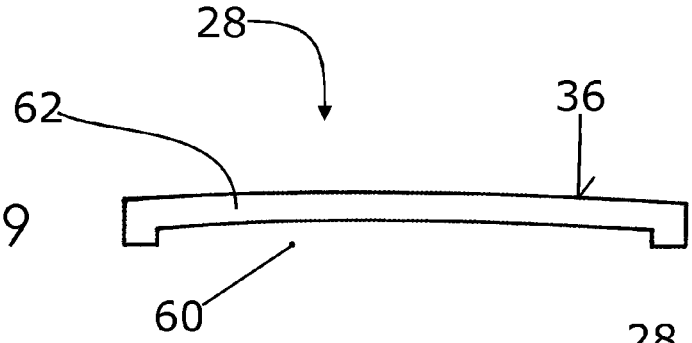
FIG. 9: is a sectional view according to FIG. 7, but now in a curved implementation

The third exemplary embodiment shown in FIG. 9 shows another alternative of an exchangeable internal part 28. Here, in addition thereto, the surface 36 is smooth. It is curved. It can be seen that the highest raised portion is located in the geometrical center of the surface 36 of the internal part 28. The highest raised portion is located above the center of the step plate 22.

The internal part 28 is preferably placed in the center of the external part 26; this is shown in all the exemplary embodiments.

In the implementation shown in FIG. 9, there is an air chamber 60 or a free space underneath the layer 62 forming the surface 36. Here, the internal part 28 is spaced from the surface of the step plate 22. When loaded, this air chamber 60 is reduced. In the implementation shown in FIG. 9, the internal part 28 is made from two layers; it has the upper, more resilient thinner layer 62 and a lower layer that is formed by the air chamber 60.

Figure 10:
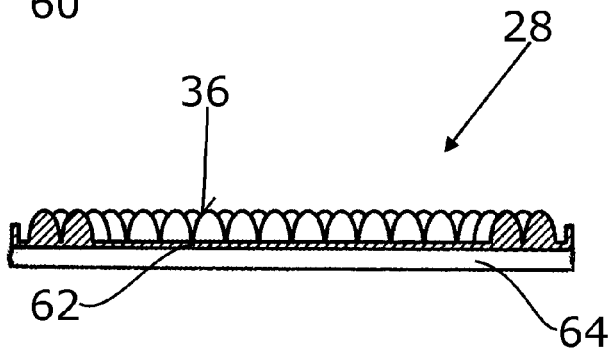
FIG. 10: is a sectional view like FIG. 7, but now with a two layer configuration.

In the implementation of the internal part 28 shown in FIG. 10, the surface 36 is again level. It is formed by studs 32. Underneath the layer 62 there is now a layer 64 made from a very soft material such as foam rubber. It has the same function as the air chamber 60 in the exemplary embodiment shown in FIG. 9.

The invention claimed is:

1. A stirrup insert for a stirrup, comprising a bearing surface and a holding area, said bearing surface having a surface for placing a boot, said holding area being detachably connected to said stirrup, wherein said bearing surface comprises an internal part and an external part, said external part surrounding said internal part at least in a longitudinal direction of said stirrup insert, said external part being made in one piece out of rubber or elastomer and comprising said holding area.

2. The stirrup insert as set forth in claim 1, wherein the hardness in Shore of said internal part is between 20 and 50 degrees and the hardness of said external part is between 50 and 90 degrees in Shore.

3. The stirrup insert as set forth in claim 1, wherein said internal part is configured to be softer compared to said external part, the fact that said internal part is configured to be softer compared to said external part is achieved by at least one of the following technical features:

a. the material of said internal part is softer than the material of said external part;

b. said internal part is built from at least two layers, namely from one upper, resilient and thinner layer and one lower layer that is made of a substantially softer material than said upper layer; and c. different rubber materials or elastomers are used for said internal part and said external part.

4. The stirrup insert as set forth in claim 1, wherein a surface of said internal part projects upward at least 1 mm with respect to the surface of said external part.

5. The stirrup insert as set forth in claim 1, wherein said internal part is slightly curved outward, said curve having an apex and said apex projecting upward at least 1 mm with respect to said external part.

6. The stirrup insert as set forth in claim 1, wherein said internal part is permanently connected to said external part.

7. The stirrup insert as set forth in claim 1, wherein said internal part comprises an oval shaped border.

8. The stirrup insert as set forth in claim 1, wherein said external part has a window into which said internal part is inserted.

9. The stirrup insert as set forth in claim 1, wherein said internal part is at least 10 degrees of Shore hardness softer than said external part.

10. The stirrup insert as set forth in claim 1, wherein said internal part is configured to be softer compared to said external part, the fact that said internal part is configured to be softer compared to said external part is achieved by the following technical features: said internal part is built from at least two layers, namely from one upper, resilient and thinner layer and one lower layer that is made of a substantially softer material than said upper layer; wherein said lower layer is made from foam rubber.

11. The stirrup insert as set forth in claim 1, wherein a surface of said internal part projects upward at least 3 mm in the y-direction, with respect to the surface of said external part, said internal part is slightly curved upward in the y-direction.

12. The stirrup insert as set forth in claim 1, wherein said internal part is slightly curved upward in the y-direction, said curve having an apex and said apex projecting upward at least 3 mm with respect to said external part.

13. The stirrup insert as set forth in claim 1, wherein said internal part is at least 20 degrees of Shore hardness softer than said external part.

14. The stirrup insert as set forth in claim 1, wherein said internal part and said external part have a studded structure.

15. A stirrup insert for a stirrup, comprising a bearing surface and a holding area, said bearing surface having a surface for placing a boot, said holding area being detachably connected to said stirrup, wherein said bearing surface comprises an internal part and an external part, said external part surrounding said internal part at least in a longitudinal direction of said stirrup insert, said external part being made in one piece out of rubber or elastomer and comprising said holding area, said internal piece being made in one piece out of rubber or elastomer.

16. A stirrup insert for a stirrup, comprising a bearing surface and a holding area, said bearing surface having a surface for placing a boot, said holding area being detachably connected to said stirrup, wherein said bearing surface comprises an internal part and an external part, said external part surrounding said internal part at least in a longitudinal direction of said stirrup insert, said external part being made in one piece out of rubber or elastomer and comprising said holding area, said internal piece being made in one piece out of rubber or elastomer, said external piece and said internal piece constituting said stirrup insert.

17. A stirrup insert for a stirrup, comprising a bearing surface and a holding area, said bearing surface having a surface for placing a boot, said holding area being detachably connected to said stirrup, wherein said bearing surface comprises an internal part and an external part, said external part surrounding said internal part at least in a longitudinal direction of said stirrup insert, said internal part being made in one piece out of rubber or elastomer and comprising said holding area.

* * * * *